US010195514B2

(12) United States Patent
Davis et al.

(10) Patent No.: US 10,195,514 B2
(45) Date of Patent: Feb. 5, 2019

(54) HOCKEY SKATE INCLUDING A ONE-PIECE FRAME WITH INTEGRAL PEDESTALS

(71) Applicant: EASTON HOCKEY, INC., Van Nuys, CA (US)

(72) Inventors: Stephen J. Davis, Van Nuys, CA (US); David Perreault, Laval (CA); Dmitry Rusakov, Montreal (CA); Ian Fung, Van Nuys, CA (US)

(73) Assignee: BAUER HOCKEY, LLC, Exeter, NH (US)

( * ) Notice: Subject to any disclaimer, the term of this patent is extended or adjusted under 35 U.S.C. 154(b) by 0 days.

(21) Appl. No.: 14/920,664

(22) Filed: Oct. 22, 2015

(65) Prior Publication Data

US 2016/0114239 A1 Apr. 28, 2016

Related U.S. Application Data

(60) Provisional application No. 62/067,241, filed on Oct. 22, 2014.

(51) Int. Cl.

| | |
|---|---|
| ***A63C 1/00*** | (2006.01) |
| ***A63C 1/30*** | (2006.01) |
| ***A63C 1/32*** | (2006.01) |
| ***A63C 1/02*** | (2006.01) |
| ***A63C 1/20*** | (2006.01) |
| ***A63C 1/28*** | (2006.01) |

(52) U.S. Cl.

CPC ..... *A63C 1/303* (2013.01); *A63C 1/02* (2013.01); *A63C 1/20* (2013.01); *A63C 1/28* (2013.01); *A63C 1/32* (2013.01)

(58) Field of Classification Search

CPC .. A63C 1/303; A63C 1/22; A63C 1/32; A63C 1/30; A63C 1/28

See application file for complete search history.

(56) References Cited

U.S. PATENT DOCUMENTS

| | | | | |
|---|---|---|---|---|
| 37,934 A | | 3/1863 | Yates | |
| 1,371,609 A | | 3/1921 | Drevitson | |
| 1,666,690 A | | 4/1928 | Drevitson | |
| 4,509,276 A | * | 4/1985 | Bourque | A43B 5/1683 12/142 R |

(Continued)

FOREIGN PATENT DOCUMENTS

| | | |
|---|---|---|
| CA | 2638352 | 2/2009 |
| CA | 2638352 A1 | 2/2009 |

(Continued)

OTHER PUBLICATIONS

Extended Search Report dated Jul. 25, 2014 in connection with European Patent Application No. 14160032.0, 5 pages.

(Continued)

*Primary Examiner* — Hau V Phan

(57) ABSTRACT

A hockey skate includes a fiber-reinforced, composite frame, or an injected plastic frame, including a boot form and integral pedestals that serve as a blade-holder. The pedestals are integral with the bottom of the boot sole and are optionally spaced relatively far apart to provide a long span between them. An optional bridge assembly may be used to connect the blade to the pedestals. The bridge assembly may provide increased stiffness and vibration damping, as well as customized fit options.

20 Claims, 8 Drawing Sheets

(56) References Cited

U.S. PATENT DOCUMENTS

| | | | | |
|---|---|---|---|---|
| 4,549,742 | A | 10/1985 | Husak et al. | |
| 5,248,156 | A | 9/1993 | Cann et al. | |
| 5,326,115 | A * | 7/1994 | Seltzer | A43B 5/1658 280/11.19 |
| 5,484,148 | A * | 1/1996 | Olivieri | A63C 1/303 280/11.17 |
| 5,641,169 | A | 6/1997 | Bekessy | |
| 5,769,434 | A | 6/1998 | Wurthner | |
| 5,988,683 | A * | 11/1999 | Venier | A63C 1/30 280/11.12 |
| 6,109,622 | A * | 8/2000 | Reynolds | A63C 1/303 280/11.17 |
| 6,164,667 | A * | 12/2000 | Olivieri | A63C 1/32 280/11.12 |
| 6,485,033 | B2 | 11/2002 | Nicoletti | |
| 6,761,363 | B2 | 7/2004 | Fask et al. | |
| 7,380,801 | B2 | 6/2008 | Rudolph | |
| 7,628,405 | B2 | 12/2009 | Smith | |
| 7,673,884 | B2 | 3/2010 | Wuerthner | |
| 7,758,053 | B2 * | 7/2010 | Wylie | A63C 1/32 280/11.12 |
| 7,866,675 | B2 | 1/2011 | Hauser | |
| 7,896,363 | B2 * | 3/2011 | Lovejoy | A43B 5/1641 280/11.12 |
| 8,109,536 | B2 | 2/2012 | Labonté | |
| D659,216 | S | 5/2012 | Wuerthner | |
| 8,329,083 | B2 * | 12/2012 | Jou | A43B 5/1666 264/257 |
| 8,353,535 | B2 * | 1/2013 | Salmon | A63C 1/28 280/600 |
| 8,505,217 | B2 * | 8/2013 | Stewart | A43B 5/1691 36/115 |
| 8,770,595 | B2 * | 7/2014 | Cruikshank | A63C 1/22 280/11.14 |
| 9,295,901 | B2 * | 3/2016 | Cruikshank | A63C 1/22 |
| 2006/0082081 | A1 | 4/2006 | Loveridge | |
| 2006/0108751 | A1 | 5/2006 | Labonté | |
| 2008/0001369 | A1 * | 1/2008 | Wylie | A63C 1/32 280/11.12 |
| 2008/0100008 | A1 | 5/2008 | Wan | |
| 2009/0224494 | A1 | 9/2009 | Wan | |
| 2010/0176564 | A1 * | 7/2010 | Koyess | A63C 1/32 280/11.12 |
| 2010/0192412 | A1 * | 8/2010 | Stewart | A43B 5/1691 36/89 |
| 2011/0001297 | A1 | 1/2011 | Labonté et al. | |
| 2011/0198834 | A1 | 8/2011 | Olivieri | |
| 2012/0317842 | A1 * | 12/2012 | McClelland | A43B 1/0081 36/115 |
| 2014/0250733 | A1 | 9/2014 | Cruikshank et al. | |
| 2014/0252736 | A1 * | 9/2014 | Lefebvre | A43B 5/1625 280/11.12 |
| 2016/0236065 | A1 * | 8/2016 | Cruikshank | A63C 1/22 |

FOREIGN PATENT DOCUMENTS

| | | |
|---|---|---|
| EP | 2478937 | 7/2011 |
| EP | 2478937 A1 | 7/2012 |

OTHER PUBLICATIONS

Restriction Requirement dated May 15, 2015 in connection with U.S. Appl. No. 14/212,468, 8 pages.
Office action dated May 8, 2015 in connection with European Patent Application No. 14160032.0, 3 pages.
Non-Final Office Action dated Sep. 10, 2015 in connection with U.S. Appl. No. 14/212,468, 16 pages.
Final Office Action dated Mar. 1, 2016 in connection with U.S. Appl. No. 14/212,468, 20 pages.
Restriction Requirement dated Mar. 14, 2016 in connection with U.S. Appl. No. 14/920,664, 8 pages.
Extended Search Report dated Jul. 25, 2014 in connection with EP Application 14160032.0, 5 pages.
Restriction Requirement dated May 15, 2015 for U.S. Appl. No. 14/212,468, 8 pages.
Office Action dated May 8, 2015 issued in connection with EP Application 14160032.0, 3 pages.
Non-Final OA dated Sep. 10, 2015 issued in connection with U.S. Appl. No. 14/212,468, 16 pages.
Final Office Action dated Mar. 1, 2016 in connection with U.S. Appl. No. 14/212,468, 16 pages.
Easton, Hockey Catalog 2000, Extracts of pp. 5, 6 and 7.
Mission holder called the driveshaft with a carbon insert—print out of web page from hockey world website—Jul. 13, 2015.
Mission Hockey catalog 1998 showing the driveshaft with carbon insert and the skate with the driveshaft, 3 pages.
Easton catalog 1999—composit blade holder, 5 pages.
Easton catalog 1998—composit blade holder, 7 pages.

* cited by examiner

HOCKEY SKATE INCLUDING A ONE-PIECE FRAME WITH INTEGRAL PEDESTALS

CROSS REFERENCE TO RELATED APPLICATIONS

This application claims the benefit of U.S. Provisional Application No. 62/067,241, filed Oct. 22, 2014, which is incorporated herein by reference in its entirety.

BACKGROUND

Hockey skates need to meet several criteria to perform at a high level. A hockey skate, for example, must support acceleration forces, cornering forces, and stopping forces. The modern sport of hockey, featuring ever-increasing athleticism of players, demands even more from a hockey skate.

Traditional hockey skates generally include three main components: a boot, a blade-holder (or "holder"), and a steel blade. The boot receives the wearer's foot and is typically made of one or more lightweight materials. The holder is typically a plastic frame including pedestals that connect the boot to the steel blade. The pedestals of the holder are attached to a sole plate of the boot. Traditional holders are generally designed to substantially reduce or eliminate flex in the skate and to fix the blade to the boot such that minimal blade deflection occurs.

Holders are typically connected to the boot via several metal rivets (for example, 14 metal rivets) or similar fasteners. Metal rivets, however, are relatively heavy and do not rigidly fix the holder to the skate boot. Rather, despite the numerous rivets used, energy losses typically result from relative movement that occurs between the boot and the holder. Manufacturing inconsistencies, such as varying rivet-hole locations, can cause improper alignment between the holder and the boot. Further, clearance typically occurs between the outer diameter of the rivet and the inner diameter of the holes in the holder, and the rivets tend to stretch or elongate the holes in the boot and holder during use. Thus, despite the many fasteners used to fix the holder to the boot, numerous variables exist that can negatively affect the energy transfer between the boot and the holder.

Modern hockey players generally desire relatively light and stiff skates. A lighter skate is easier to maneuver, while a stiffer skate transmits leg motion to the skate more efficiently. While these features are generally preferred, certain skaters may prefer different performance properties from their skates.

An effective and efficient skate provides efficient energy transfer during acceleration, cornering, and stopping. During forward acceleration, increased pressure is applied to the front portion of the blade as the skater applies downforce on the balls of the feet, much like a runner. In order to achieve efficient energy transfer to the ice, resulting in maximum blade contact with the ice, the skate or blade needs to deflect or bend. A skate that is capable of twisting allows the rear portion of the skate to rotate toward the lateral or medial side, which allows the blade to contact the ice in this area. If there is no torsional deflection, the blade will partially contact the ice in the front area where the downward force is concentrated, resulting in reduced power transfer.

During cornering, the skater's leg angle changes and the cornering action places a high rotational force on the skate. To efficiently accommodate this change in force, the skate requires a relatively high rotational stiffness. A skate is also subjected to quick directional changes, often initiated by ankle movement. This movement generally distributes force to the interface between the boot and the holder. A traditional skate with an attached holder, however, allows some relative movement between the boot and the holder such that some energy is not transferred to the blade.

During stopping, the skater applies the blade at a cross angle to the direction of travel while leaning inward to place the edge of the blade on the ice to stop momentum. This action places a higher rotational force on the skate than cornering. As with cornering, any relative movement between the boot and holder will reduce the transfer of energy, and thus the stopping force.

SUMMARY

A hockey skate includes a fiber-reinforced, composite frame, or an injected plastic frame, including a boot form and integral pedestals that serve as a blade-holder. The pedestals are integral with the bottom of the boot sole and are optionally spaced relatively far apart to provide a long span between them. An optional bridge assembly may be used to connect the blade to the pedestals. The bridge assembly may provide increased stiffness and vibration damping, as well as customized fit options. Other features and advantages will appear hereinafter. The features described above can be used separately or together, or in various combinations of one or more of them.

BRIEF DESCRIPTION OF THE DRAWINGS

In the drawings, wherein the same reference number indicates the same element throughout the views.

DETAILED DESCRIPTION

Various embodiments of the invention will now be described. The following description provides specific details for a thorough understanding and enabling description of these embodiments. One skilled in the art will understand, however, that the invention may be practiced without many of these details. Additionally, some well-known structures or functions may not be shown or described in detail so as to avoid unnecessarily obscuring the relevant description of the various embodiments.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list. Further, unless otherwise specified, terms such as "attached" or "connected" are intended to include integral connections, as well as connections between physically separate components.

Figure 1:
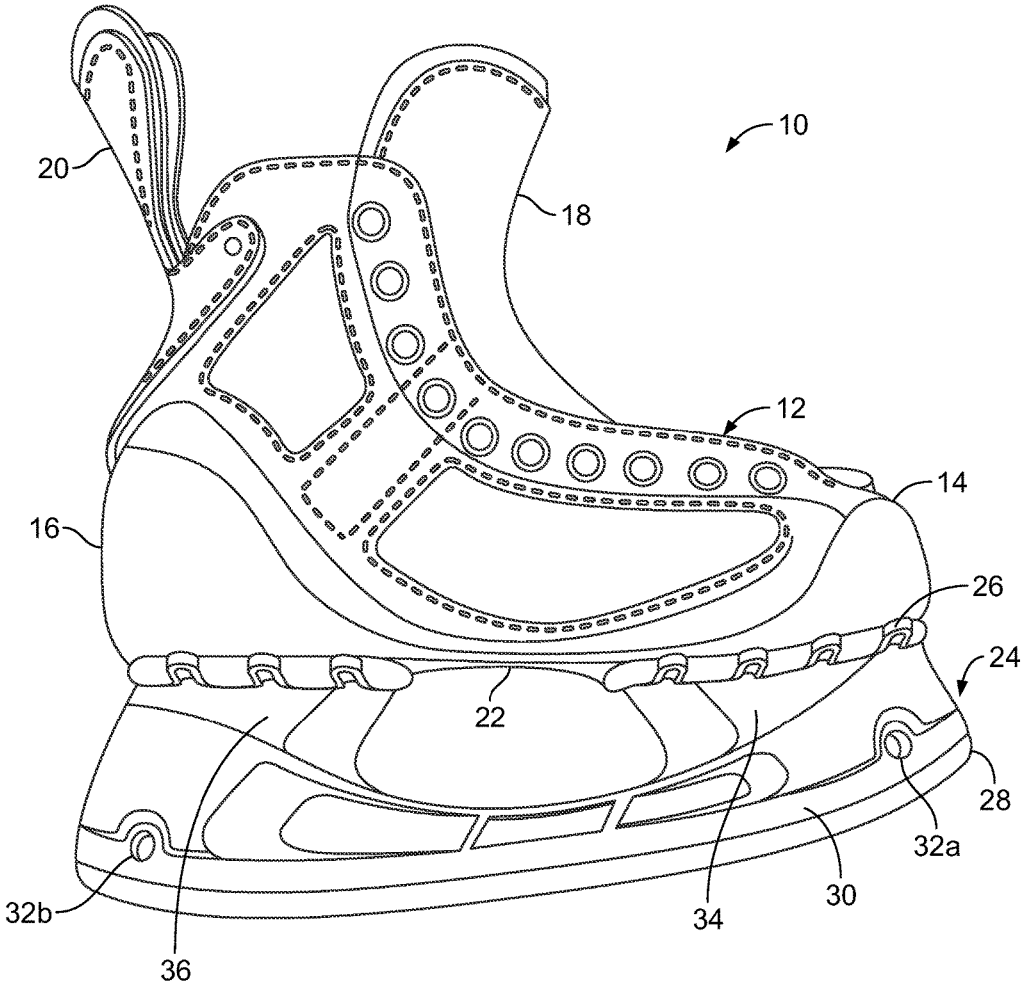
FIG. 1 (Prior Art)
FIG. 1 is a side view of a traditional hockey skate.

Turning now in detail to the drawings, FIG. 1 illustrates an example of a traditional hockey skate 10. The skate includes a boot 12 having a toe region 14, a heel region 16, a tongue 18, a tendon guard 20, and a sole 22. A blade-holder or "holder" 24 is attached to the boot 12 along the boot sole 22 through holes 26. A steel blade 28 is positioned in a groove 30 in the holder 24 and is attached via bolts 32*a* and 32*b* or screws through holes in the blade 28 and holder 24. The holder 24 includes a front pedestal 34 and rear pedestal 36. The length of the front pedestal 34 is approximately equal to the length of the rear pedestal 36, which is approximately equal to the length of the opening between the pedestals 34 and 36.

Figure 2:
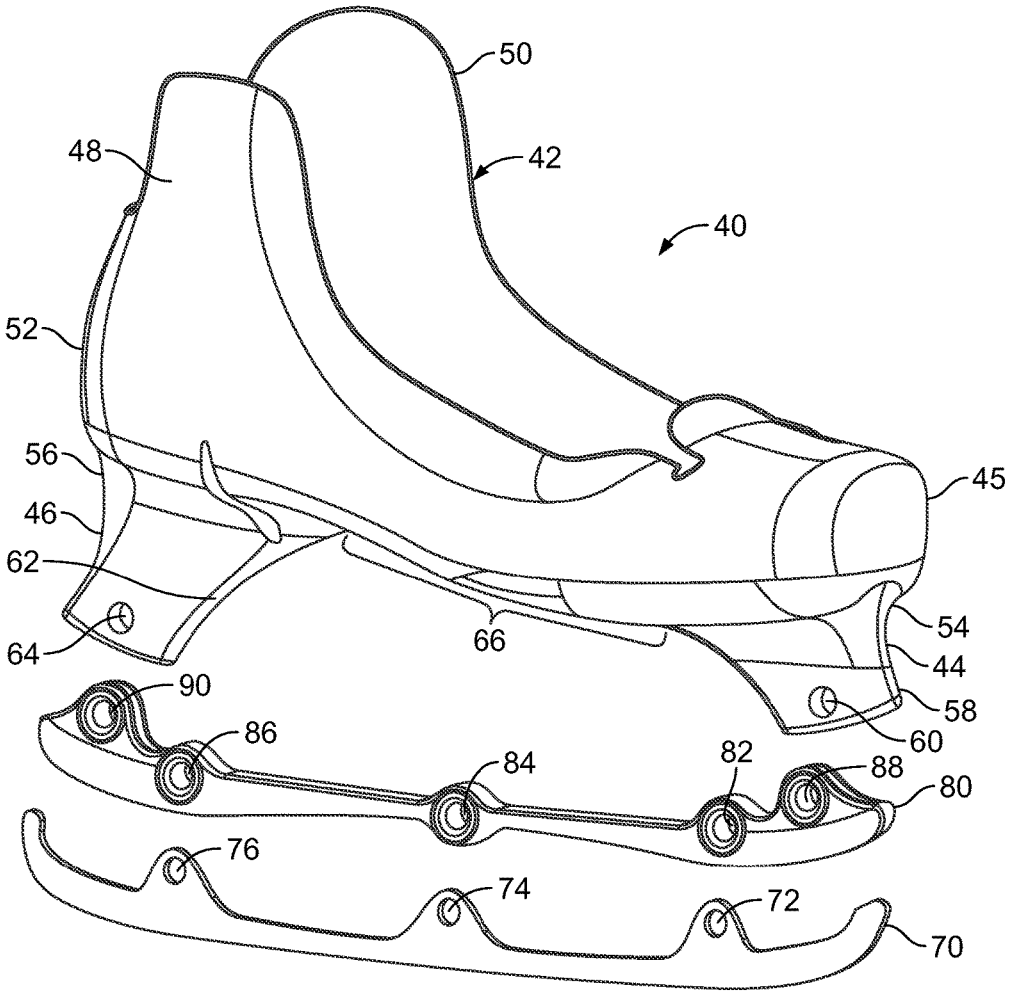
FIG. 2 is an exploded view of a skate, excluding an outer covering and other external features, according to one embodiment of the invention.
Figure 3:
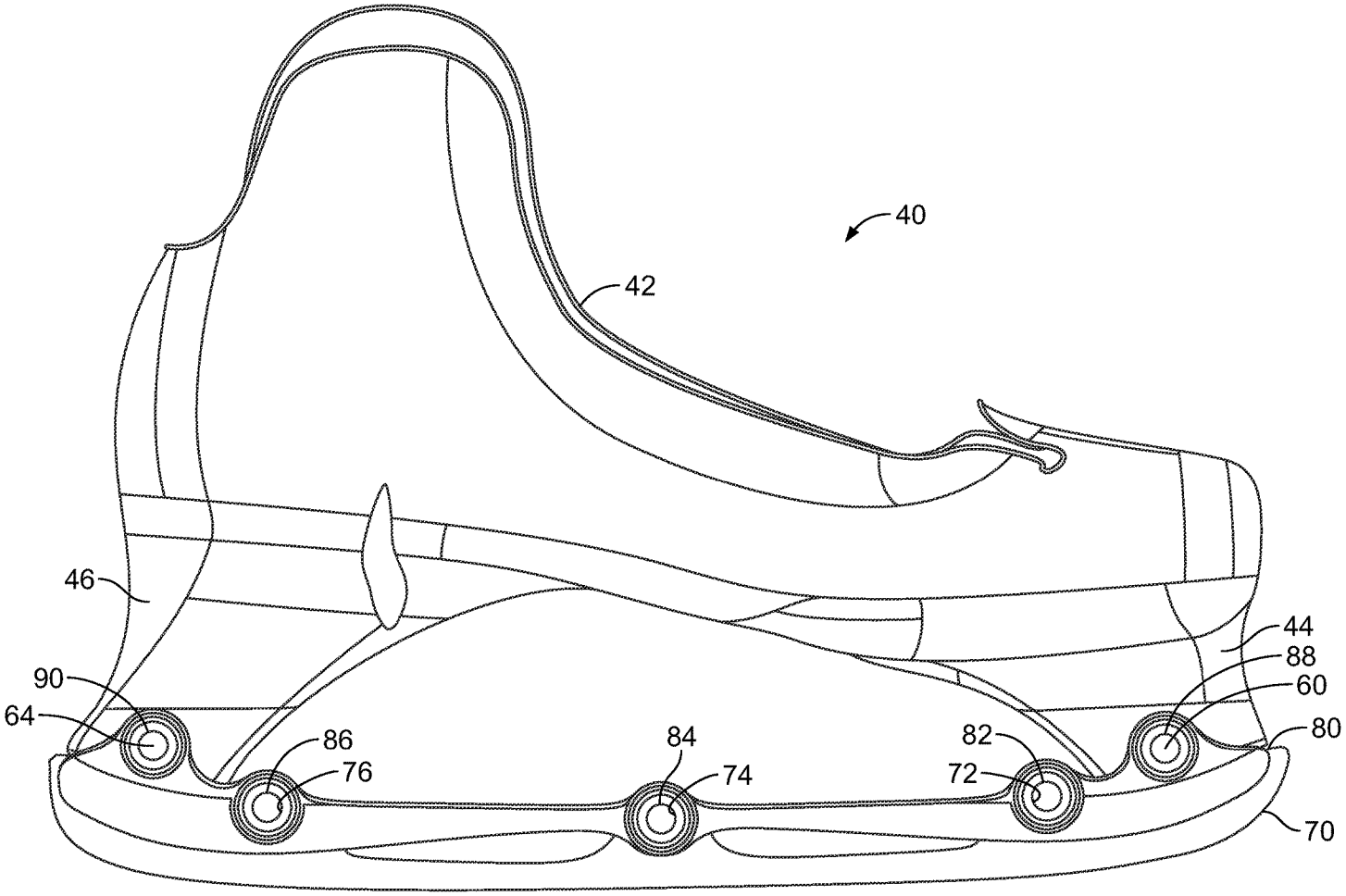
FIG. 3 is an assembled view, excluding fasteners, of the skate shown in FIG. 2.
Figure 4:
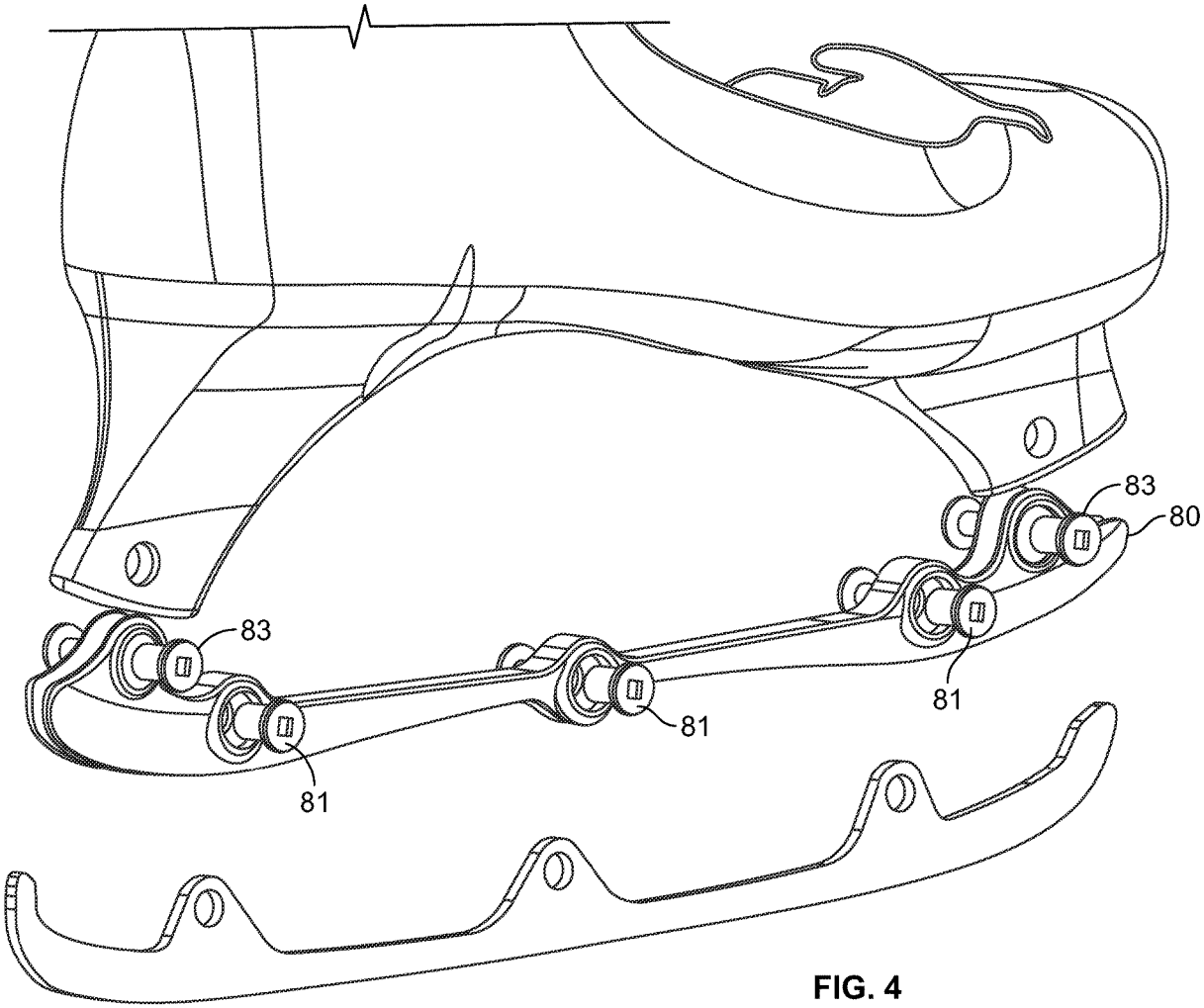
FIG. 4 is an exploded view of the skate shown in FIGS. 2 and 3 including fasteners.
Figure 10:
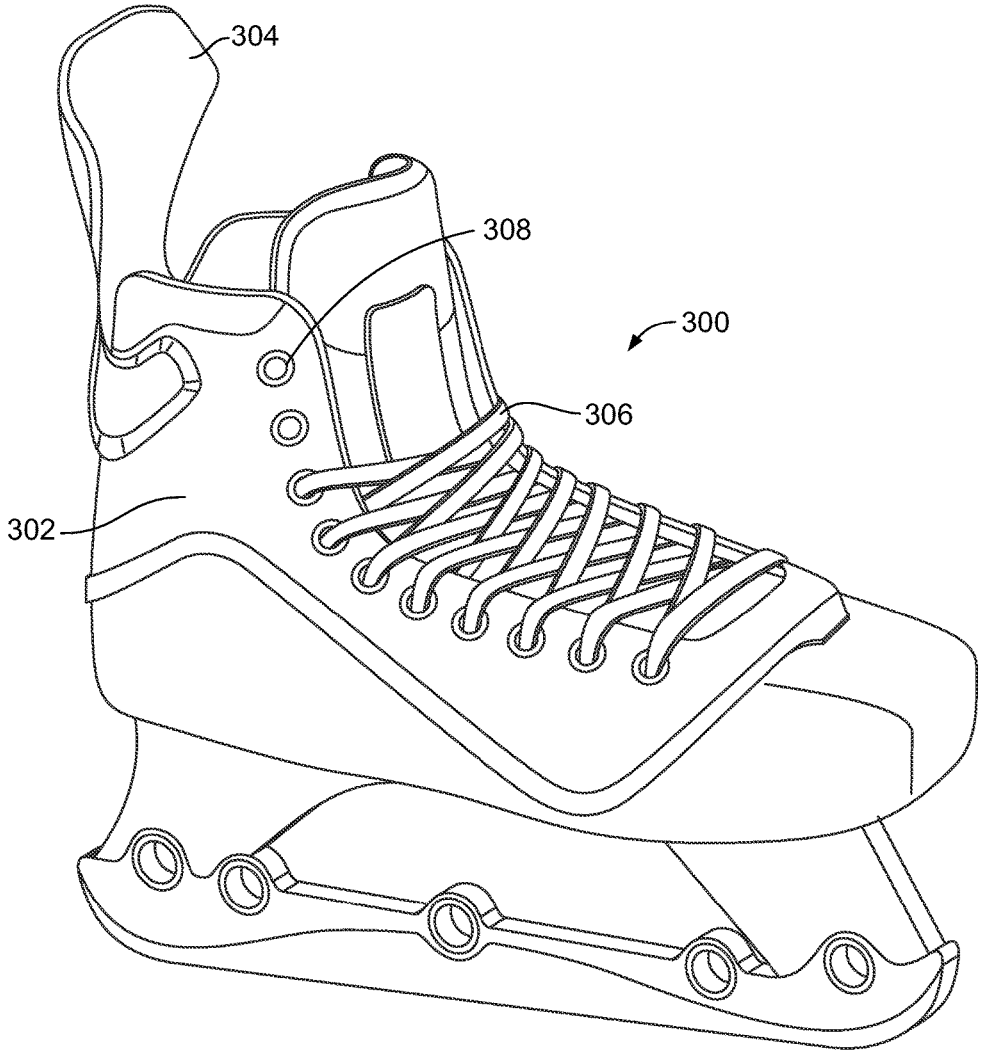
FIG. 10 is a perspective view of a skate including a boot form with integral pedestals and an outer covering, according to one embodiment.

FIGS. 2-4 illustrate the components of a skate 40, excluding the outer boot-covering materials, tendon guard, laces, and so forth, according to one embodiment of the invention. The excluded portions of the skate 40 may be attached to or integrated with the skate as described, for example, in U.S. patent application Ser. No. 13/794,071, filed Mar. 11, 2013, which is incorporated herein by reference, or in any other suitable manner. One example of skate 300 including outer boot-covering materials 302, a tendon guard 304, laces 306, lace eyelets 308, and so forth, is shown in FIG. 10. In one embodiment, the tendon guard 304 may be directly or indirectly attached to the boot form described below.

The skate 40 includes a boot form 42 that is integral with a front pedestal 44 and a rear pedestal 46 such that these components form a unitary structure. The boot form 42 includes a toe region 45, a lateral upper region 48, a medial upper region 50, and a heel region 52. The front and rear pedestals 44 and 46 are molded with or fused to a boot sole 54 to form a continuous, integrated structure. The front pedestal 44 includes a first projection 58 including a first hole or opening 60, while the rear pedestal 46 includes a second projection 62 including a second hole or opening 64.

A blade 70 may be fastened to the pedestals 44 and 46, directly or indirectly, in a variety of manners to provide a desired level of flex in the blade 70. Adding flex to the blade 70 increases compliance between the skate 40 and the ice. Ice can become rough during use, resulting in the transmission of vibrations to the skater. Increased flex or compliance of the blade 70 improves comfort for the skater when these vibrations are transmitted. In another embodiment, one or more additional pedestals may be included on the boot form 42. For example, a third pedestal may be positioned between the front and rear pedestals 44 and 46, and fastened to the blade 70, to add additional stiffness or strength.

The boot form 42 may be formed from plies of composite, fiber-reinforced polymeric materials preimpregnated with resins, or from other suitable materials. In one embodiment, a boot preform is laid up using carbon-fiber-reinforced, epoxy-impregnated materials. Once the preform is complete, the plies may be consolidated in a molding operation that applies pressure and heat to crosslink and cure the resin. This construction facilitates precise positioning of the material plies and orienting of the fibers. The boot form 42 may alternatively be formed by plastic injection molding, or by a hybrid molding process using injection molding and preimpregnated fiber tapes to form the boot form 42. In one embodiment, the tendon guard 304 may be injected using the same material, or a different material, than the boot form 42.

Other fibers may be used to construct the boot form 42, such as glass, aramid, ceramic, liquid-crystal polymer, or other suitable materials. Different resins may also be used, such as vinyl-ester thermoset resins, or thermoplastic resins may be used, such as polyamide, polyester, polyurethane, or polyethylene resins. A combination of thermoset and thermoplastic resins may also be used. In one embodiment, thermoplastic resins having a relatively low melting temperature may be used to form a portion of the boot form 42 into a desired shape.

Such a fiber-reinforced, composite structure offers anisotropic stiffness that may be tailored to achieve desired performance characteristics. In addition, the torsional stiffness and bending stiffness of the skate may be tailored for desired performance. The stiffness of the integrated structure may also be optimized by using fiber-reinforced, composite materials, and the stiffness and performance can be consistent between skates during the life of the skates.

Further, the fiber-reinforced, integrated structure may be designed with specific fiber angles, in selected locations, to achieve specific performance objectives. For example, fibers aligned with the blade 70 provide high bending stiffness, while fibers angled relative to the blade 70 provide increased flexibility and higher torsional stiffness. Preimpregnated fiber patches may also be applied in specific locations to add reinforcement where desired. In this manner, the integrated structure may be reduced in weight, since reinforcements may be positioned only where needed, and in the proper orientations. Adjacent zones of the boot form 42 may be stiff or flexible if desired to optimize performance.

The front pedestal 44 is optionally positioned at the front end of the toe region 45, and the rear pedestal 46 is optionally positioned at the rear end of the heel region 52. This positioning creates a relatively long span 66 between the pedestals 44 and 46 along the boot sole 54. A long span 66 of this nature yields a boot form 42 with increased flexibility relative to one with pedestals positioned closer together, or with pedestals that engage a longer length of the blade. For example, a longer span 66 allows for greater torsional flex of the boot form 42 and greater bending flex of the blade 70, both of which may be desirable during acceleration. The longer span 66 also creates a more comfortable skate because the blade 70 is able to absorb shock and vibrations better than a stiffer, shorter blade.

In one embodiment, the blade 70 is optionally connected to a bridge 80 that generally increases the stiffness, strength, and vibration damping of the blade 70. The blade 70 may be connected to the bridge 80 by fasteners 81 passing through holes 72, 74, and 76 in the blade 70, and through holes 82, 84, and 86 in the bridge 80. The bridge 80 may be made of a lightweight metal, such as aluminum, magnesium, or titanium, or of a fiber-reinforced composite material, or of another suitable material. The bridge 80 is connected to the pedestals 44 and 46 by fasteners 83 passing through holes 60 and 64 in the pedestals 44 and 46, and through holes 88 and 90 in the bridge 80.

Inclusion of a bridge 80 is particularly desirable when the span 66 between the pedestals 44 and 46 is relatively long. This longer span 66 yields a more flexible blade 70, and the bridge 80 provides added stability and strength. The thickness of the bridge 80 may be selected as needed to support a given blade 70 and to meet the preferences of a given skater. The bridge 80 may also vary in thickness along its cross section, with thicker sections providing additional support in local areas. For example, the bridge 80 may have a thicker cross section at the mid-region of the blade 70, near the bridge hole 84, than in other regions.

Figure 3A:
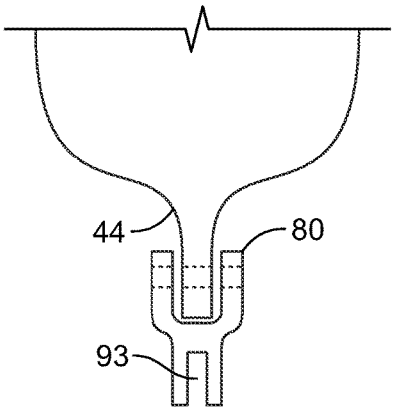
FIG. 3A. is a front-end view of the front pedestal and bridge of the skate shown in FIG. 3.
Figure 3B:
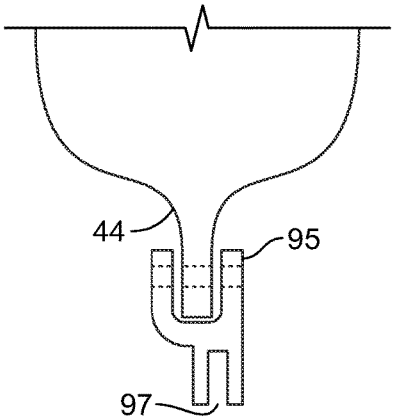
FIG. 3B is a front-end view of a front pedestal attached to a bridge including a laterally offset groove that receives a blade, according to one embodiment.
Figure 3C:
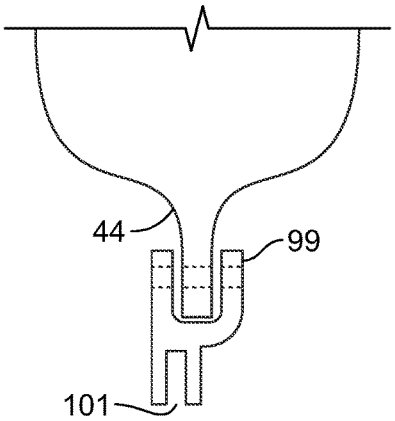
FIG. 3C is a front-end view of a front pedestal attached to a bridge including a medially offset groove that receives a blade, according to one embodiment.

As shown in FIG. 3A, the bridge 80 may include a blade-receiving slot or groove 93 aligned with the center of the front pedestal 44 (or rear pedestal 46), or the blade-receiving groove may be offset relative to the center of the pedestal 44 or the central axis of the skate. For example, FIG. 3B illustrates an embodiment in which a bridge 95 includes a blade-receiving groove 97 that is positioned to the lateral side of the pedestal 44 and the central axis of the skate. FIG. 3C, conversely, illustrates an embodiment in which a bridge 99 includes a blade-receiving groove 101 that is positioned to the medial side of the pedestal 44 and the central axis of the skate. Thus, the groove in the bridge may be positioned to meet the preferences of a given skater.

This adjustability and customizability may be utilized at one or more of the pedestals. For example, in one embodiment, the horizontal angle of the blade 70 made be modified by including a laterally offset blade-receiving groove in the front portion of the bridge (or in the in the front pedestal 44 itself), and a medially offset blade-receiving groove in the rear portion of the bridge (or in the in the rear pedestal 46 itself), or vice versa. The pitch angle of the blade 70 may also be adjusted by raising the front connection portion and lowering the rear connection portion, or vice versa. Further, the cant or vertical angle of the blade 70 may be adjusted by including a varying cant angle of the blade groove.

Figure 5:
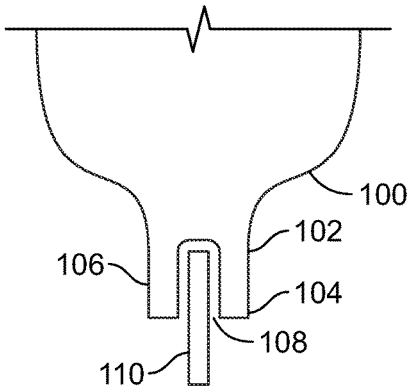
FIG. 5 is a front-end view of a pedestal including a split projection that receives a blade, according to one embodiment.

As shown in FIG. 5, in one embodiment, one or both pedestals 100 of a boot form may include a split projection including a first leg 104 and a second leg 106 that form a blade-receiving space 108 between them. An upper portion of a blade 110 is positioned in the space 108 and attached to the legs 104 and 106 via fasteners, such as the fasteners described above or other suitable fasteners.

Figure 6:
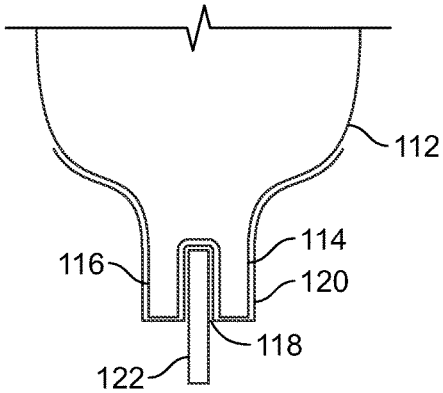
FIG. 6 is a front-end view of a pedestal including a split projection and a spacer positioned between legs of the split projection and a blade, according to one embodiment.

As shown in FIG. 6, in another embodiment, one or both pedestals 112 of a boot form may include a split projection including a first leg 114 and a second leg 116 that form a blade-receiving space 118 between them. An upper portion of a blade 122 is positioned in the space 118 and attached to the legs 114 and 116 via fasteners, such as the fasteners described above or other suitable fasteners. A spacer 120 is positioned between the blade 122 and the legs 114 and 116. The spacer 120 may be made of a polymer film or plastic to add protection to the pedestal 112. Alternatively, the spacer 120 may be made of a lightweight metal to provide support to the pedestal 112. In one embodiment, a metal spacer 120 may optionally be coated with a polymer film to add protection to the pedestal 112 and the spacer 120.

The size of the spacer 120 may vary depending on how much protection or support is desired. The spacer 120 may also act as a bridge that connects the blade 122 to each pedestal 112. In one embodiment, the thickness of the spacer 120 may vary in different regions to adjust the horizontal (i.e., medial-lateral) position of the blade 70 in those regions.

Figure 6A:
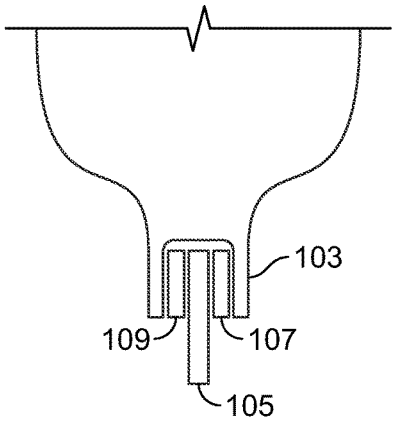
FIG. 6A is a front-end view of a pedestal including a wide split projection and multiple spacers positioned between legs of the split projection and a blade, according to one embodiment.

As shown in FIG. 6A, in one embodiment, one or both pedestals 103 may include a wide split to accommodate spacers 107 and 109 that adjust the horizontal (i.e., medial-lateral) position of the blade 105. Any suitable number of spacers, each having any desired thickness, may be used to adjust the blade position.

Figure 7:
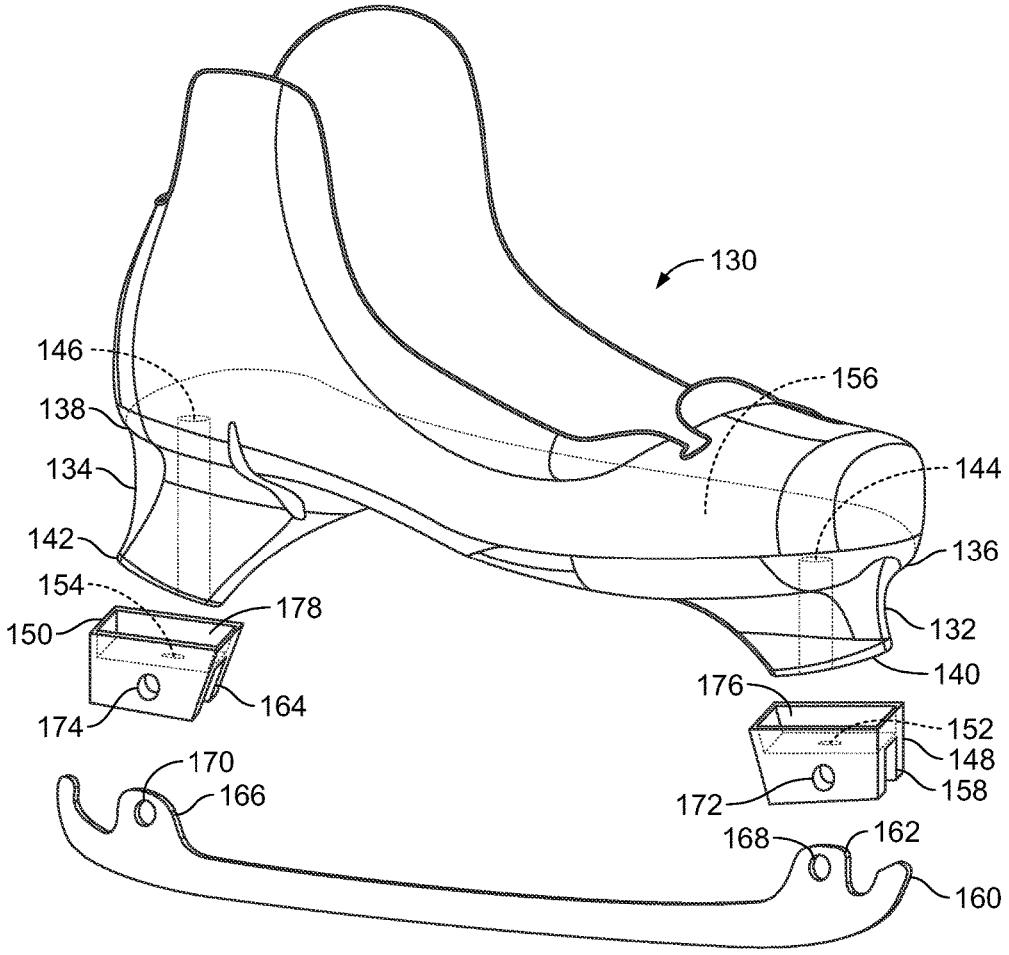
FIG. 7 is an exploded view of a skate, excluding an outer covering and other external features, including a boot form with integral pedestals and separate blade-holders that fit over the pedestals, according to one embodiment.

As shown in FIG. 7, in another embodiment, a boot form 130 includes an integral front pedestal 132 and rear pedestal 134. The front and rear pedestals 132 and 134 may be shaped like truncated pyramids or similar shapes, with wider base regions 136 and 138 and narrower tip regions 140 and 142, respectively. A front holder 148 and a rear holder 150 are shaped to fit precisely or snugly over the tips 140 and 142 of the pedestals 132 and 134, respectively. In one embodiment, the holders 148 and 150 each include a perimeter skirt 176 and 178 to snugly secure the holders 148 and 150 to the pedestals 132 and 134. The skirts 176 and 178 may also offer protection to the boot structure. The holders 148 and 150 may optionally be replaceable parts, similar to the blade 160.

The front and rear pedestals 132 and 134 may include internal holes or openings 144 and 146 for alignment with holes or openings 152 and 154 in holders 148 and 150, respectively. The holders 148 and 150 may be secured to the pedestals 132 and 134 using fasteners that pass through openings 144 and 146 and openings 152 and 154, or via other suitable connectors. In one embodiment, threads may be molded inside openings 144 and 146 or openings 152 and 154 to receive threaded connectors, such as bolts or screws.

Figure 8:
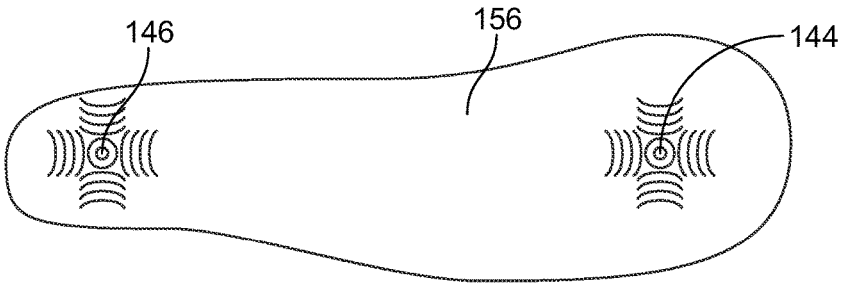
FIG. 8 is a top view of the boot sole of the skate shown in FIG. 7.

As shown in FIG. 8, in one embodiment, access to the openings 144 and 146 may be provided in the inner surface of the floor 156 of the boot form 130. A wrench or other tool may be used to tighten the fasteners to secure the holders 148 and 150 to their respective pedestals 132 and 134.

The front holder 148 may include a longitudinal groove 158 configured to receive a tab or other engagement portion 162 of the blade 160. Similarly, the rear holder 150 may include a longitudinal groove 164 configured to receive a tab or other engagement portion 166 of the blade 160. Fasteners may be used to secure the blade 160 to the holders 148 and 150 through blade holes 168 and 170 and holder holes 172 and 174, respectively.

The embodiment shown in FIGS. 7 and 8 offers several options and advantages. For example, the holders 148 and 150 may be made of a rigid or flexible material depending on the desired performance or feel, or they may be made of different materials than each other. The holders 148 and 150 may also be made of materials that provide vibration damping, if desired. Further, the holders 148 and 150 may have different configurations to vary the location of the blade relative to the boot form 130. For example, one or more of the grooves 158 and 164 may be located closer to the lateral or medial sides of the holders 148 and 150. The grooves 158 and 164 may also be oriented at an angle, for example, at an angle relative to a longitudinal axis of the boot, or at an angle relative to a vertical axis of the boot. The holders 148 and 150 may also vary the fore and aft position of the blade 160 relative to the boot form 130. In one embodiment, the holders 148 and 150 may be connected to each other to act as a bridge that adds stability or stiffness to the blade 160.

Figure 9:
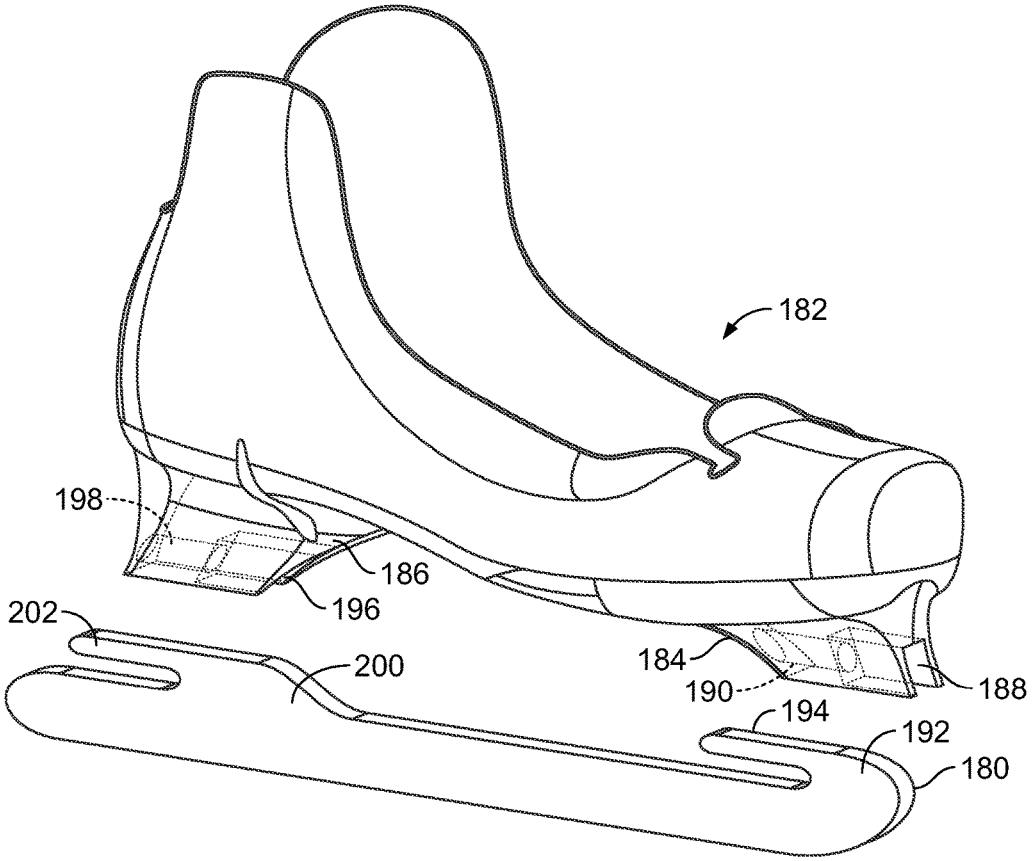
FIG. 9 is an exploded view of a skate, excluding an outer covering, including a boot form with integral pedestals and a blade longitudinally fastened to the pedestals, according to one embodiment.

As shown in FIG. 9, in another embodiment, a blade 180 is attached to a boot form 182 via longitudinal tabs or engagement portions 192 and 200 that include longitudinal protrusions 194 and 202, respectively. The boot form 182 includes an integral front pedestal 184 and rear pedestal 186. The front pedestal 184 may include a longitudinal groove 188 and an interior channel 190 that receive the engagement portion 192 and protrusion 194, respectively, of the blade 180. Similarly, the rear pedestal 186 may include a longitudinal groove 196 and an interior channel 198 that receive the engagement portion 200 and protrusion 202, respectively, of the blade 180.

The ends of the protrusions 194 and 202 may be threaded or may include other openings that facilitate their securement to the pedestals 184 and 186, using nuts and bolts or other fasteners. Alternatively, in one embodiment, only one of the rear protrusion 202 and the front protrusion 194 is attached such that, when the attachment is secured, the blade 180 is held under tension to secure it in place. In another embodiment, one or more quick-release or tool-less fasteners may be used to secure one or more of the protrusions 194 and 202 to their respective pedestals and 184 and 186.

The embodiments described herein provide several advantages. For example, relative movement between the boot form and the blade may be minimized or eliminated, depending on the objectives of a given design. The unitary boot form-and-pedestal structure eliminates many rivets or other energy-absorbing structures, resulting in a lighter and more responsive skate. Thus, the unitary structure will perform more consistently over a longer period of time.

Further, a skate offering varied flexibility, or flexibility in a particular zone, provides benefits. Traditional skate boots are generally designed to be as stiff as possible in all directions. The boot forms described herein, conversely, may have different stiffness properties in different directions and locations. The integral pedestals, for example, may provide high stiffness because they are integrated with boot form. The region between the pedestals, conversely, may be considerably more flexible, allowing a controlled amount of twisting and bending in this area. The skate may also include geometric features that further tailor this zonal bending and twisting stiffness.

Another benefit is the provision of consistent and reliable blade orientation and location. A typical skate has a separate boot and holder that are fastened together. The one-piece, boot form-and-pedestal structure, conversely, may be formed by tooling, such that multiple structures may be molded in the same geometry, resulting in precise and consistent orientation and positioning of the blade assembly.

Any of the above-described embodiments may be used alone or in combination with one another. Further, the described skate may include additional features not described herein. While several embodiments have been shown and described, various changes and substitutions may of course be made, without departing from the spirit and scope of the invention. The invention, therefore, should not be limited, except by the following claims and their equivalents.

What is claimed is:

1. A hockey skate comprising:

a boot form for receiving a skater's foot, the boot form comprising a medial side portion, a lateral side portion, an ankle portion, a heel portion and a sole portion; and a blade-holding portion projecting below the sole portion of the boot form and configured to hold a blade;

wherein the medial side portion, the lateral side portion, the ankle portion, the heel portion, and the sole portion of the boot form and the blade-holding portion are integrally molded.

2. The hockey skate of claim 1, wherein the blade-holding portion comprises a plurality of pedestals spaced apart longitudinally relative to each other and configured to hold the blade.

3. The hockey skate of claim 2, wherein the pedestals are configured to directly engage the blade to hold the blade.

4. The hockey skate of claim 1, comprising the blade.

5. The hockey skate of claim 1, wherein the medial side portion, the lateral side portion, the ankle portion, the heel portion and the sole portion of the boot form comprise fiber-reinforced composite material.

6. The hockey skate of claim 5, wherein the blade-holding portion comprises fibre-reinforced composite material integral with the fiber-reinforced composite material of the medial side portion, the lateral side portion, the ankle portion, the heel portion and the sole portion of the boot form.

7. The hockey skate of claim 5, wherein the fiber-reinforced composite material of the boot form is fiber-reinforced polymeric material.

8. The hockey skate of claim 2, wherein the boot form and the blade-holding portion are injection molded together.

9. The hockey skate of claim 1, wherein the boot form comprises a toe portion.

10. The hockey skate of claim 1, comprising a tendon guard for overlapping an Achilles tendon of the skater.

11. The hockey skate of claim 1, wherein the blade-holding portion is configured to receive a fastener to hold the blade.

12. The hockey skate of claim 11, wherein the fastener engages the blade.

13. The hockey skate of claim 11, wherein the blade-holding portion comprises a plurality of pedestals configured to receive a blade-holding member to hold the blade and the fastener engages the blade-holding member.

14. The hockey skate of claim 1, wherein the blade-holding portion is configured to hold the blade such that the blade is offset relative to a widthwise center of the hockey skate.

15. The hockey skate of claim 1, wherein the blade-holding portion comprises a slot to receive the blade.

16. The hockey skate of claim 1, comprising at least one of a quick-release fastener or a tool-less fastener for the blade-holding portion to selectively hold and release the blade.

17. The hockey skate of claim 1, wherein the blade-holding portion comprises a pre-formed opening configured to receive a fastener to fasten the blade to the blade-holding portion.

18. The hockey skate of claim 1, comprising an outer boot-covering material layered over the boot form and configured to cover at least part of the boot form.

19. The hockey skate of claim 1, wherein blade-holding portion defines a void between the blade and the sole portion of the skate boot.

20. A hockey skate comprising:

a boot form for receiving a skater's foot, the boot form comprising a medial side portion, a lateral side portion, an ankle portion, a heel portion, and a sole portion; and a blade-holding portion projecting below the sole portion of the boot form and configured to hold a blade, the blade-holding portion comprising a pre-formed opening configured to receive a fastener to fasten the blade to the blade-holding portion;

wherein the medial side portion, the lateral side portion, the ankle portion, the heel portion, and the sole portion of the boot form and the blade-holding portion are integrally molded and include fiber-reinforced material.

* * * * *